United States Patent [19]

Halliez

[11] Patent Number: 4,774,877

[45] Date of Patent: Oct. 4, 1988

[54] AIR CONDITIONING SYSTEM FOR A RAILWAY CAR HAVING TWO SINGLE-STOREY END COMPARTMENTS AND A TWO-STOREY CENTRAL COMPARTMENT

[75] Inventor: Gérard Halliez, Valenciennes, France

[73] Assignee: Alsthom, Paris Cedex, France

[21] Appl. No.: 67,176

[22] Filed: Jun. 29, 1987

[30] Foreign Application Priority Data

Jun. 27, 1986 [FR] France ..... 86 09382

[51] Int. Cl.[4] ..... B61D 27/00

[52] U.S. Cl. ..... 98/14

[58] Field of Search ..... 98/2, 2.11, 2.15, 5, 98/10, 14

[56] References Cited

U.S. PATENT DOCUMENTS

| | | | |
|---|---|---|---|
| 2,143,827 | 1/1939 | Demarest | 98/10 X |
| 2,152,129 | 3/1939 | Anderson | 62/6 |
| 2,212,897 | 8/1940 | Crawford et al. | 98/5 |
| 2,223,940 | 12/1940 | Ragsdale et al. | 98/5 |
| 2,698,569 | 1/1955 | Reynolds | 98/10 |

OTHER PUBLICATIONS

198 Glasers Annalen, Zeitschrift für Eisenbahnwesen und Verkehrstechnik 109 (1985) Okt., No. 10, Berlin, Germany, pp. 412–414.

*Primary Examiner*—Harold Joyce

*Attorney, Agent, or Firm*—Sughrue, Mion, Zinn, Macpeak, and Seas

[57] ABSTRACT

The heating and ventilating system for a railway car having two single-storey end compartments (A, B) and a two-storey (C1, C2) central compartment (C), comprises heating/ventilating units (1A, 1B) in the top parts of each end compartment, each supplying a transverse distribution duct (3A, 3B) connected to two longitudinal ducts (4A, 5A; 4B, 5B) blowing into the end compartment and to two other longitudinal ducts (10A, 11A; 10B, 11B) blowing into one storey of the central compartment. The four longitudinal ducts (10A, 11A; 10B, 11B) blowing into the central compartment are located in two casings (20) forming part of the floor structure of said second storey, both ducts from one of the air units being provided with auxiliary, vertical ducts (12).

3 Claims, 4 Drawing Sheets

AIR CONDITIONING SYSTEM FOR A RAILWAY CAR HAVING TWO SINGLE-STOREY END COMPARTMENTS AND A TWO-STOREY CENTRAL COMPARTMENT

This invention concerns an air conditioning system for a railway car having two single-level end compartments and one two-level central compartment, the system comprising, in the top part of each end compartment, a heating and ventilating plant, hereinafter termed "air unit", feeding a transverse distribution duct connected to two longitudinal ducts blowing into the end compartment and also connected to two other longitudinal ducts blowing into one of the levels of the two-level central compartment, said central compartment thus comprising four longitudinal ducts.

In the prior art air conditioning systems of this type, the central compartment comprises two ducts at floor level in the first level and two ducts at floor level in the second level.

At the floor level of this second level, the two ducts are add-on elements not forming part of the floor structure. The second storey floor therefore extends from one side to the other of the car and thus presents a considerable cantilever, which is a source of unwanted vibrations.

This invention is directed to reducing the cantilevering of the second storey floor and thus bringing about a greater rigidity. This goal is attained by providing a casing to each side of the second storey floor, which limits the width of said floor. Moreover, in order to simplify the construction of such a duct system, the two ducts of the prior art, located at the floor level of the first storey, are according to the invention installed instead at the level of the second storey floor and each integrated into a casing.

The inventive duct system has four longitudinal ducts blowing into the central compartment, but these ducts are arranged in two casings being part of the structure of the second storey floor, the two ducts of one air unit having vertical auxiliary ducts appended thereto.

In a first embodiment of the invention, each vertical auxiliary duct is provided at one end with a diffuser operable to direct air at the level of the feet of passengers in the first level, the two longitudinal ducts of the other air unit being provided along their lengths with evenly spaced diffusers to blow air out at the level of the feet of the passengers in the second level.

According to a second embodiment, each vertical appended duct is provided at one end thereof with a diffuser operable to direct air at head level of the passengers in the second level, the two longitudinal ducts of the other air unit being provided along their lengths with evenly spaced diffusers to blow air at head level of the passengers in the first level, this second mode being mainly reserved for cool air blowing.

There will now be described hereunder, with reference to the appended drawings, a prior art duct system as well as, by way of example, the two embodiments according to the invention.

FIGS. 1 and 2 are schematic drawings of a railway car having two end compartments A, B and a central compartment C, the latter having two levels C1, C2 which are more readily distinguishable in FIGS. 3 and 4.

Figure 1:
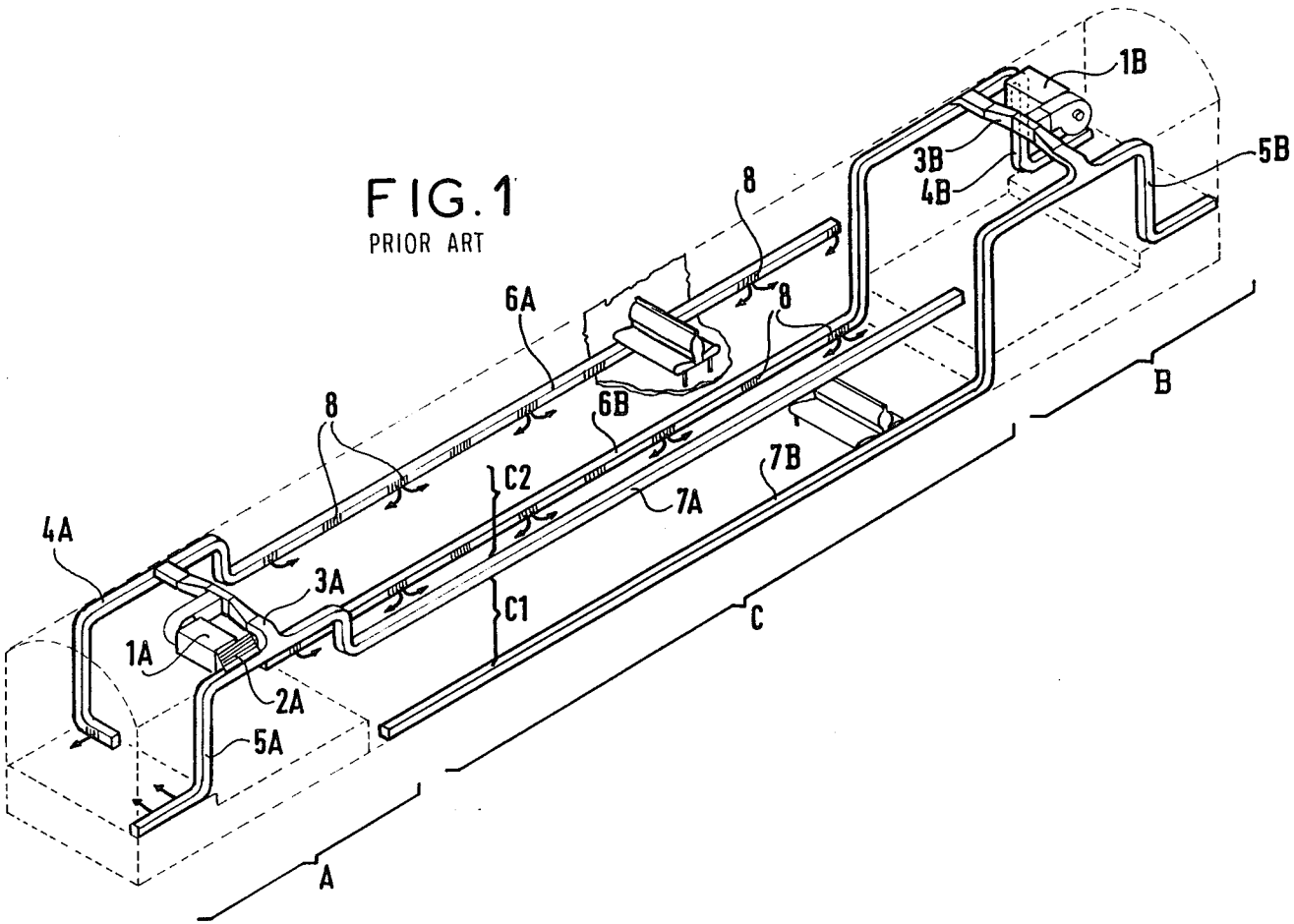
FIG. 1 PRIOR ART
FIG. 1 illustrates a prior art bi-level railcar air conditioning system.

In the air conditioning system illustrated in FIG. 1, each car end compartment A, B comprises a heating and ventilation unit 1A, 1B which draws air from the outside of the car through a grill 2—only one grill 2A being depicted in the drawing—and blows into a transverse duct 3A, 3B connected to two longitudinal ducts 4A, 5A; 4B, 5B supplying air to the end compartment A, B respectively, and to two other longitudinal ducts 6A, 7A; 6B, 7B supplying the central compartment C. The two longitudinal ducts 6A, 7A of air unit 1A are located one to each side of the second level of the central compartment, at floor level. The two longitudinal ducts 6B, 7B of unit 1B are located one to each side of the first level of the central compartment, at floor level.

The four ducts 6A, 7A, 6B, 7B of the central compartment supply air to the two car levels via diffusers 8 distributed along their entire lengths.

Figure 2:
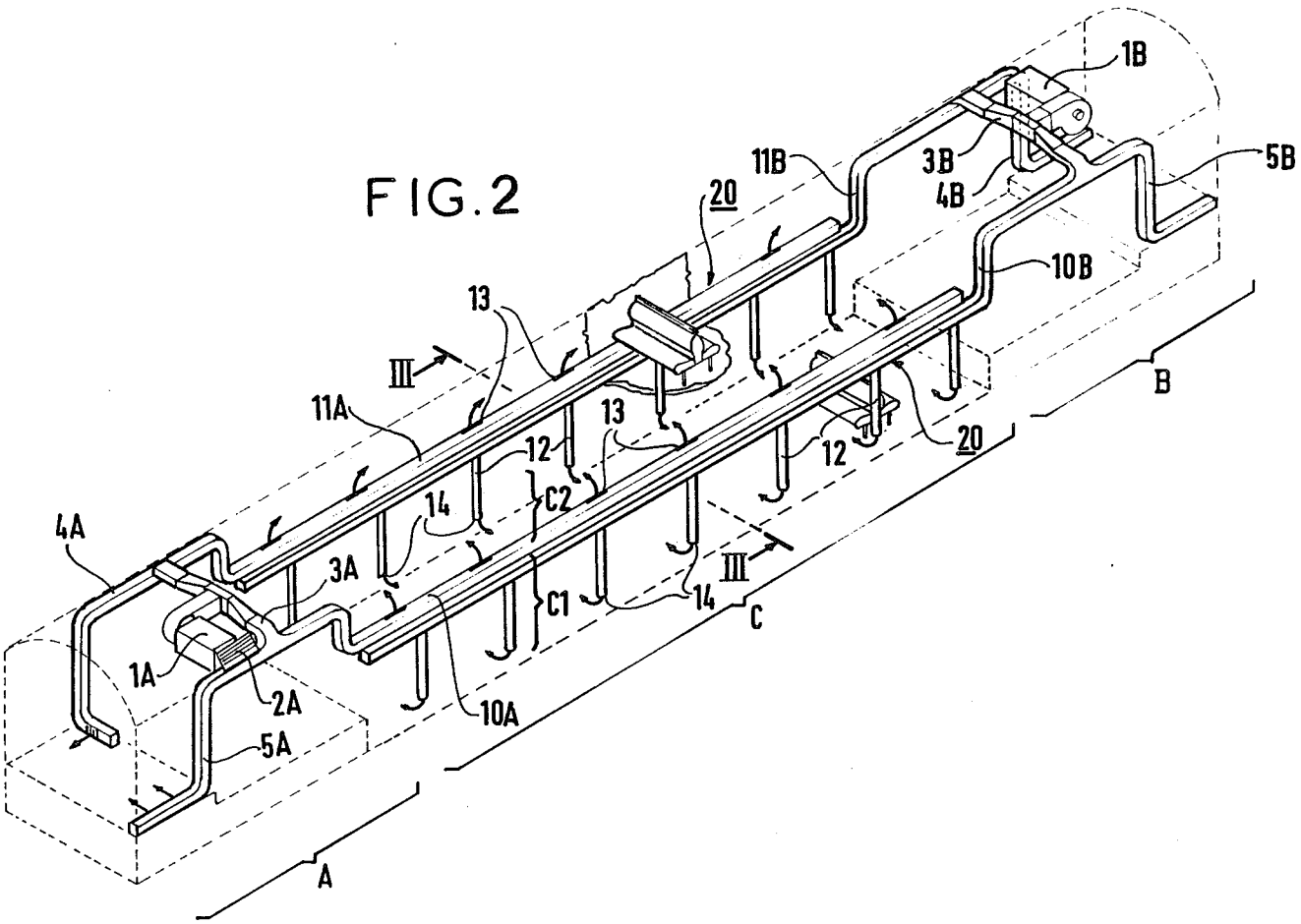
FIG. 2 shows the first above-mentioned embodiment of the invention.

FIG. 2 shows an air conditioning system comprising, in each end compartment, like elements to those of FIG. 1, namely a heating and ventilation unit 1A, 1B drawing air from the outside via a grill 2 only one grill 2A being depicted in the drawing—and blowing into a transverse duct 3A, 3B connected to two longitudinal ducts 4A, 5A; 4B, 5B supplying the end compartment A, B respectively, and into two other longitudinal ducts 10A, 11A; 10B, 11B supplying the central compartment. The two longitudinal ducts 10A, 11A of end compartment A, as 6A and 7A in FIG. 1, are located at floor level of the second storey, but, in accordance with the invention the longitudinal ducts 10B, 11B of end compartment B are also located at the level of the second storey floor.

The two ducts 10A, 11A have diffusers 13 distributed along their entire lengths and the two ducts 10B, 11B are provided, in accordance with the first embodiment of the invention, with appended vertical ducts 12 evenly spaced along their lengths. The end of each vertical duct 12 is equipped with a diffuser 14. Diffusers 13 and 14 are readily apparent in FIGS. 3 and 4.

Duct 10A of unit 1A supplies one side of the second storey of the central compartment, at floor level, and duct 11A of unit 1A supplies the other side of the second storey, at floor level.

Duct 10B of unit 1B supplies, via its appended ducts 12, one side of the first storey of the central compartment, at floor level, and duct 11B of unit 1B supplies, via its appended ducts 12, the other side of the first storey, at floor level.

Figure 3:
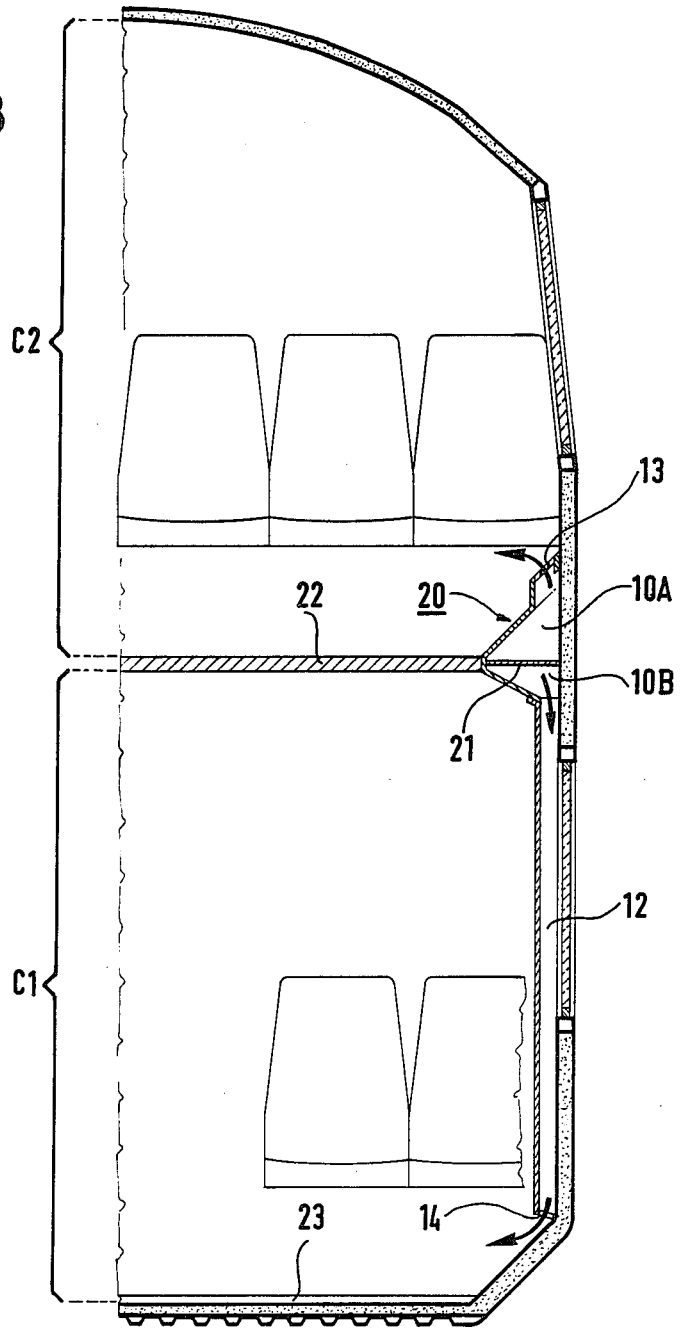
FIG. 3 shows the same embodiment, in half cross-section taken along III—III of FIG. 2.

FIG. 3 shows in half cross-section along III—II of FIG. 2 the central compartment and its two storeys C1, C2 each equipped with a floor, 22, 23 respectively. The floor 22 is connected to a casing 20 contributing to the rigidity of said floor and, obviously, the other side of floor 22 not shown is connected to another casing 20.

The casing 20 illustrated encloses the two ducts 10A, 10B separated by a partition 21 and the casing not shown encloses the two ducts 11A, 11B also separated by a partition.

Duct 10A and duct 11A not shown are provided with diffusers 13 along their entire lengths, supplying air to the second storey C2 at its floor level 22. Each vertical auxiliary duct 12 of ducts 10B and 11B not shown supplies air to the first storey C1 at the level of the floor 23 thereof via a diffuser 14.

Figure 4:
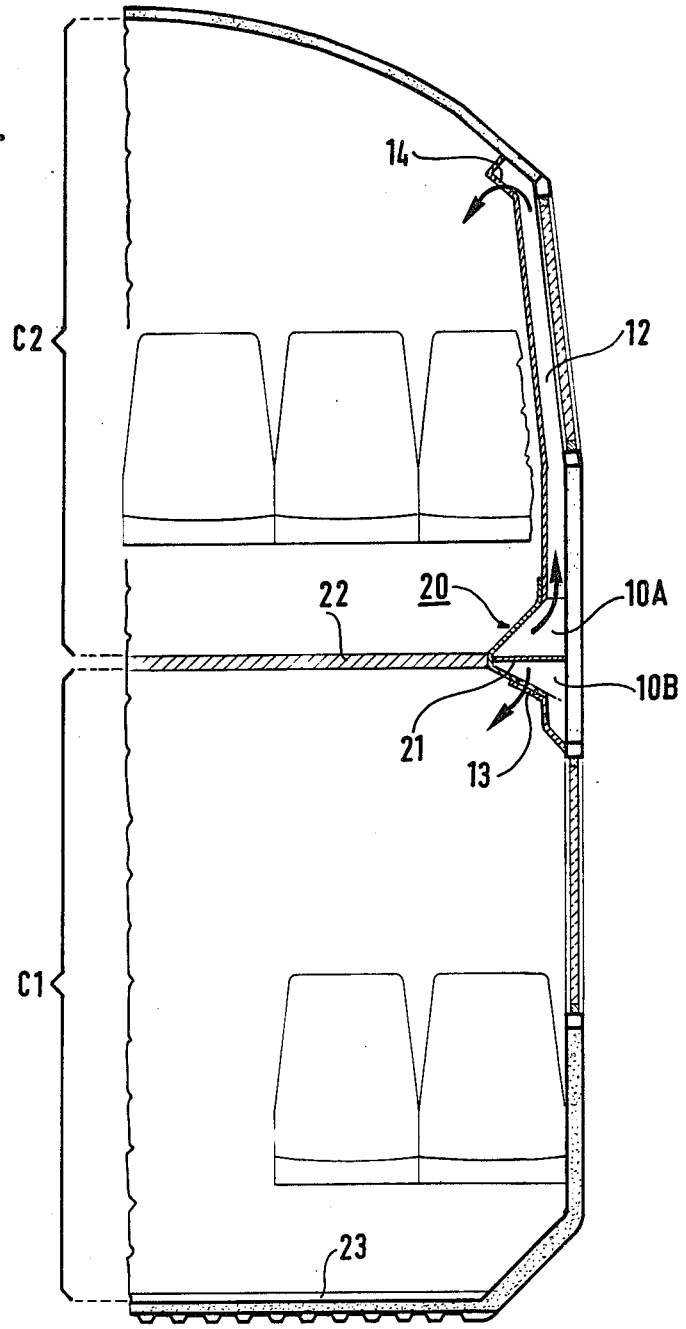
FIG. 4 shows the second above-mentioned embodiment in half cross-section taken in the same plane.

In the second embodiment illustrated in FIG. 4, the ducts 10A, 11A are the ones provided with auxiliary ducts 12, each said auxiliary duct having a diffuser 14 which supplies air to the second storey at ceiling level, the ducts 10B, 11B being provided with diffusers 13 which supply air to the first storey at ceiling level.

What is claimed is:

1. An air conditioning system for a railway car having two single-level end compartments and one two-level central compartment, a second-storey floor within said central compartment dividing said central compartment into a lower first storey and a upper second storey, a heating and ventilating air unit at each of said two single-level and compartments, a transverse distribution duct connected to each said heating and ventilating air unit and connected to two longitudinal ducts extending into a respective end compartment proximate thereto and said transverse distribution duct being further connected to two other longitudinal ducts extending into a respective one of the levels of the two-level central compartment, the improvement comprising a pair of casings forming part of the structure of the second-storey floor to opposite sides of the railway car and within said first storey and said second storey, the two other longitudinal ducts are housed in the respective casings, one of said two other longitudinal ducts for one heating and ventilating air unit extending into the lower first storey and a respective one of said two other longitudinal ducts of said other heating and ventilating air unit extending into the upper second storey thereby reducing the cantilevering of the second-storey floor and bringing about a greater rigidity to the railway car while simplifying the construction of the duct system and reducing unwanted vibrations, and wherein said system further comprises auxiliary vertical ducts connected to both longitudinal ducts within said central compartment of one air unit at longitudinally spaced positions throughout the central compartment, with said auxiliary vertical ducts opening to the interior of one storey of said central compartment remote from said second storey floor to direct air at the level of the feet or head of passengers in said one storey.

2. The air conditioning system according to claim 1, wherein said vertical auxiliary ducts depend downwardly from said casing forming part of the structure of the second-storey floor within said first storey, and wherein each vertical auxiliary duct is provided at one end with a diffuser for directing air at the level of the feet of passengers in the first storey, and wherein the two other longitudinal ducts of the other air unit within said two casings within said second storey are provided along their lengths with evenly spaced diffusers to direct air at the level of the feet of the passengers in the second storey.

3. An air conditioning system according to claim 1, wherein said vertical auxiliary ducts extend vertically upwardly within the second storey of said central compartment from said casings forming part of the structure of the second-storey floor at longitudinally spaced positions within said central compartment with each vertical auxiliary duct being provided at an end remote from the casing with a diffuser for directing air at the head level of passengers in the second storey, and wherein the two other longitudinal ducts of the other air unit are provided along their lengths with evenly spaced diffusers within said first storey to direct air into said first storey at the head level of the passengers.

* * * * *